United States Patent [19]

Bucher

[11] Patent Number: 4,563,881

[45] Date of Patent: Jan. 14, 1986

[54] CONTAINER FOR COOLING A COOLED COMMODITY

[75] Inventor: Peter Bucher, Pfäffikon, Switzerland

[73] Assignee: Firma Heinrich Bucher, Fällanden, Switzerland

[21] Appl. No.: 638,015

[22] Filed: Aug. 6, 1984

[30] Foreign Application Priority Data

Aug. 8, 1983 [CH] Switzerland ..... 4302/83

[51] Int. Cl.[4] ..... F25D 3/08

[52] U.S. Cl. ..... 62/457; 62/119

[58] Field of Search ..... 62/119, 457

[56] References Cited

U.S. PATENT DOCUMENTS

| | | | |
|---|---|---|---|
| 2,005,611 | 6/1935 | Carson, Jr. | 62/119 X |
| 2,036,756 | 4/1936 | Hull | 62/119 |
| 2,044,609 | 6/1936 | Hedlund | 62/119 X |
| 2,610,472 | 9/1952 | Maxwell | 62/457 X |
| 3,564,727 | 2/1971 | Fraser | 62/119 X |
| 4,135,371 | 1/1979 | Kesselring et al. | 62/119 X |
| 4,333,517 | 6/1982 | Parro | 62/119 X |

*Primary Examiner*—Lloyd L. King

*Attorney, Agent, or Firm*—Bachman & LaPointe

[57] ABSTRACT

A container has a cooled commodity storage part and a coolant storage part. The container contains at least one heat pipe along one container wall wherein the hot part of the heat pipe extends through the cooled commodity storage part, while the cold part of the heat pipe extends into the coolant storage part. The heat transfer in the cooled commodity part is improved by metal walls, with which the hot part of the heat pipe is in contact, and by ribs in the coolant part. This considerably increases the heat flow compared with known containers, so as to give a more uniform and better temperature distribution in the cooled commodity part and wherein the heat can be removed from points where higher heat losses occur.

5 Claims, 5 Drawing Figures

CONTAINER FOR COOLING A COOLED COMMODITY

BACKGROUND OF THE INVENTION

The invention relates to a container for cooling a cooled commodity using a coolant, in whose inner area the coolant stored in a coolant part is separated from a cooled commodity part by a wall.

It is known to store a cooled commodity to be stored cool in a cooling container, which is independant of any connection to a cooling system. In the case of large, stationary or mobile containers, it is known to directly assemble a refrigerating plant with the cooling container to form a unit. This known arrangement of cold production directly on the cooling container is also used in simplified form in the case of smaller containers. In particular, movable and/or transportable containers are known, such as are widely used in the transportation sector, such as on the railways, in ships and in aircraft. While using a suitable refrigerating agent, for example dry ice (solid $CO_2$), such cooling containers are intended to make it possible to keep the cooled commodity below ambient temperature for a certain period of time. Containers are known, which are used for storing meals and food and which are used for supplying aircraft passengers. The relevant health authorities generally prescribe what temperature range must be adhered to for such products.

If such cooled commodity containers containing a stock of a coolant, that is dry ice are used, the cooling action results from the fact that the dry ice which is mainly used as the coolant is evaporated as a result of a heat supply from the ambient or from the cooled commodity container and the resulting cold gas is introduced into the interior of the cooled commodity container. This makes it possible to at least partly compensate the losses through the cooled commodity container walls, provided that the dry ice stocks are adequate.

However, in the known dry ice-cooled cooled commodity containers, it is extremely difficult to transport the heat, particularly from areas of the cooled commodity container remote from the refrigerating agent to the latter arranged in concentrated manner at one point. It has been found that in the known cooling systems which are already in use, and which operate with free convection, that is, with a circulation based on the force of gravity and heat conduction in the walls and the detachable accessories of the cooled commodity container, satisfactory results cannot be achieved. In particular, there is no uniform cooling action in the cooled commodity part and the cooled commodities stored in the vicinity of the coolant are cooled to a greater extent and in certain cases excessively.

SUMMARY OF THE INVENTION

Thus, the problem of the present invention is to so construct a container for cooling a cooled commodity of the aforementioned type such that the heat flow between the hot and cold areas in the cooled commodity part of the container is significantly increased and consequently it is possible to achieve a better and more uniform distribution of the temperature in the coolant part.

According to the present invention, the foregoing object is achieved by providing at least one heat pipe in the cooled commodity storage part of the container and the cold part of said pipe projects into the coolant storage part and the hot part thereof projects into the cooled commodity storage part.

BRIEF DESCRIPTION OF THE DRAWINGS

The invention is described in greater detail hereinafter relative to a non-limitative embodiment and with reference to the attached drawings wherein.

DETAILED DESCRIPTION

Figure 1:
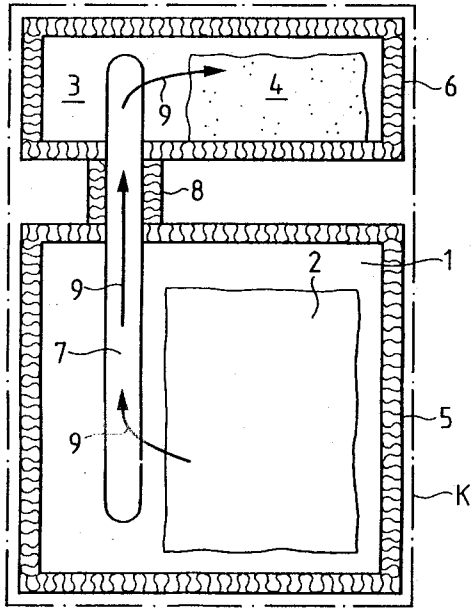
FIG. 1 is a basic diagram of a cooling means with a coolant supply.

The basic diagram of FIG. 1 diagrammatically shows a cooled commodity container K, which comprises a cooled commodity storage part 1, with a commodity 2 stored therein and a coolant storage part 3 with a stock of a coolant 4, such as dry ice stored therein. Both cooled commodity storage part 1 and coolant storage part 3 have insulation 5,6.

The invention is based on the consideration that an improvement in the temperature conditions in the known cooled commodity containers which operate with a coolant stock, can only be achieved if the heat flow between the cooled commodity storage part 1 and the coolant storage part 3 is significantly increased, so that the heat losses which occur can be compensated. This is impossible if at least one heat pipe 7 is used, wherein the hot part of the heat pipe 7 projects into the cooled commodity storage part 1 and the cold part of the heat pipe 7 projects into the coolant storage part 3. If there is a gap between the cooled commodity part 1 and the coolant part 3, the heat pipe 7 is projected into this part by insulation 8. When the heat pipe 7 is in practical use, there is generally no gap between the two parts 1 and 3.

In FIG. 1, the heat flow is represented by arrows 9. The heat pipe 7 constitutes a device which, brings about a considerable increase in the heat flow 9. This leads to a much more uniform temperature distrubution making it possible to reliably adhere to the temperature required by regulations for meals and beverages.

The heat pipe is an evacuated metal pipe, which is closed on both sides and which is made from copper or the like. It contains the saturated steam of a suitable cooling medium, such as ultra-pure water. The condensed liquid is returned by capillary action on the inner wall of the pipe or by gravity. If the hot part of heat pipe 7 is heated, there is local liquid evaporation, which leads to a pressure increase with a displacement of the steam towards the cold end of heat pipe 7. Accompanied by the giving off of its latent heat, the steam expands and condenses. The liquid flows by capillary action to the hot part and then the circuit is repeated.

Figure 2:
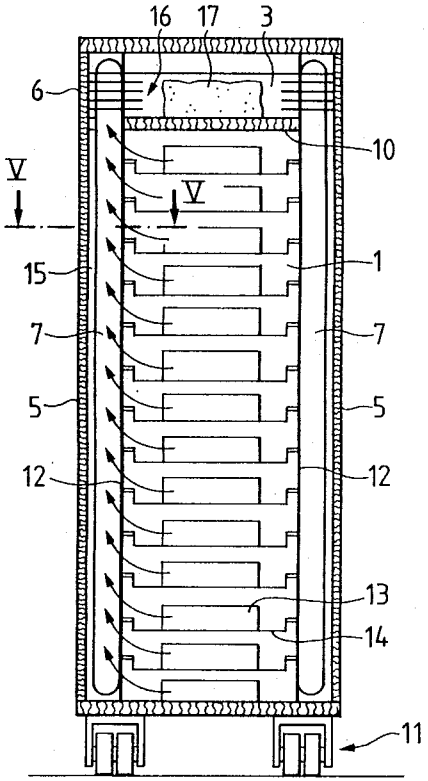
FIG. 2 is a vertical section through a diagrammatically represented transportable cooled commodity container.

The transportable cooled commodity container shown in FIG. 2 has a cooled commodity storage part 1 with an insulation 5, a coolant storage part 3 with an insulation 6, a partition 10 provided with and insulation and rollers or castors 11. Between two metal walls 12, made from aluminum or the like, in the cooled commodity part 1 is located the storage space for the cooled commodity, which is stored in individual receptacles 13 on rack boards or trays 14, see FIG. 2.

Between the metal walls 12 and the vertical container wall, there are two narrow, vertically directed spaces 15, in which there is at least one heat tube 7, which extends through the cooled commodity storage part 1 and projects into the coolant storage part 3. The number of heat tubes 7 depends on the temperature to be achieved in the cooling zone.

Figure 5:
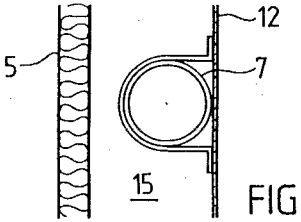
FIG. 5 is a larger scale section along line V—V in FIGS. 2 and 4.

In order to achieve the necessary high heat flow both the hot and cold parts of heat pipe 7 must be provided with means for improving the thermal conduction. In the case of the container according to FIG. 2, this is achieved in that in the hot part, see FIG. 5, the heat pipe 7 is directly fixed to the metal wall 12 and this gives a good contact there. In this case, metal wall 12 is a heat deflector, which improves the heat transfer to heat pipe 7.

In the coolant storage part 3, the cold part of heat pipe 7 may be provided with ribs 16, which are arranged in horizontal manner about a coolant stock 17 located in a shell-shaped member.

Figure 3:
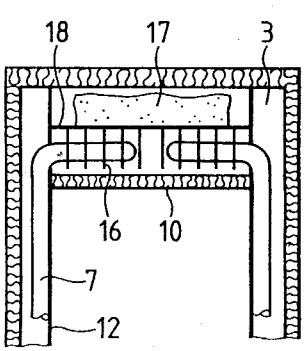
FIG. 3 is a first variant of the construction of the coolant part of the cooled commodity container according to FIG. 2.

FIG. 3 shows another arrangement of rib 16 for the cold part of heat pipe 7. The coolant stock 17 is located on a base 18, whose bottom is in contact with ribs 16.

Figure 4:
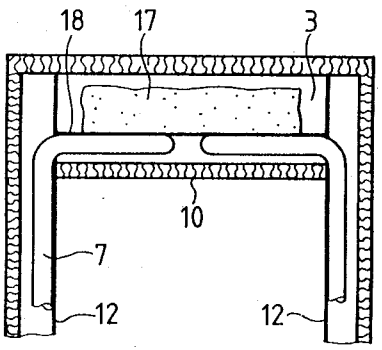
FIG. 4 is a second variant of the construction of the coolant part of the cooled commodity container of FIG. 2

FIG. 4 shows that the base 18 on which rests the coolant 17 actually serves as a heat deflector. Thus, the same arrangement is obtained, as provided in FIG. 5 for the hot part of heat pipe 7. If base 18 is constructed as a slidable tray, a good contact must be ensured with the cold part of the heat pipe or pipes 7. Appropriately base 18 and metal walls 12 are made from a good heat conducting material such as, for example, aluminum.

The aforementioned cooled commodity container is characterized by maximum simplicity. The use of heat pipe 7 makes it possible to achieve a better and more uniform temperature distribution in the cooled commodity storage part 1 and in this way completely compensates the heat losses through the container walls.

If there are still minor temperature differences in the cooled commodity storage part 1, the desired compensation can be brought about by locally increasing or decreasing the number of heat conducting surfaces. It is also possible to remove the heat from these parts which are furthest from the coolant part 3. In the case of high heat transfer, it can also be appropriate to partly insulate heat pipe 7.

So that heat pipe 7 has a larger cooling surface its cross-section need not be circular and can also have a rectangular cross-section or the like. The pipe material can also be plastic, but the pipe must always be fully sealed. The liquid return by capillary action is particularly necessary if the cold part of the heat pipe is positioned below the hot part thereof. The inner wall of the heat pipe is then lined with a layer of capillary material, which ensures the transfer of liquid into the hot part of the heat pipe.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container for cooling a commodity uniformly over the entire surface thereof using a coolant comprising a coolant storage part, a commodity storage part, means for separating said coolant storage part from said commodity storage part and a plurality of self contained heat pipes each having a cold part located in said coolant storage part and a hot part located in said commodity storage part for increasing the heat flow between said coolant storage part and said commodity storage part wherein both of the hot and cold parts of the said plurality of heat pipes are provided with conducting surfaces which improve the heat transfer of the heat pipes wherein the conducting surface for said hot part comprises a container wall in the commodity storage part which is in contact with the hot part of said plurality of heat pipes and the conducting surface for said cold part comprises a carrier for the coolant wherein the cold part of the heat pipe is bent in the coolant part and extends below the carrier for the coolant.

2. A container according to claim 1 wherein the container wall is vertical and said heat pipe is parallel to said container wall.

3. A container according to claim 1 wherein the number of conducting surfaces is locally increased or decreased.

4. A container according to claim 1 wherein the bent part of the heat pipe is connected by means of ribs with the carrier for the coolant.

5. A container according to claim 1 wherein the bent part of the heat pipe is in direct contact with the carrier for the coolant.

* * * * *